US006298907B1

(12) United States Patent
Colvin et al.

(10) Patent No.: US 6,298,907 B1
(45) Date of Patent: Oct. 9, 2001

(54) MICROCLIMATE TEMPERATURE REGULATING PAD AND PRODUCTS MADE THEREFROM

(75) Inventors: Virginia S. Colvin; David P. Colvin, both of Cary, NC (US)

(73) Assignee: Delta Thermal Systems, Inc., Cary, NC (US)

( * ) Notice: Subject to any disclaimer, the term of this patent is extended or adjusted under 35 U.S.C. 154(b) by 0 days.

(21) Appl. No.: 09/558,718

(22) Filed: Apr. 26, 2000

(51) Int. Cl.[7] ..... F28F 7/00
(52) U.S. Cl. ..... 165/46; 165/902; 62/259.3
(58) Field of Search ..... 165/46, 104.14, 165/76, 902, 136; 62/259.3; 128/402

(56) References Cited

U.S. PATENT DOCUMENTS 3,429,138 * 2/1969 Goldmerstein ..... 165/46
3,610,323 * 10/1971 Troyer ..... 165/45
3,643,463 * 2/1972 Friedlander et al. ..... 62/259
3,744,053 * 7/1973 Parker et al. ..... 165/46
4,856,294 * 8/1989 Scarigne et al. ..... 62/259
5,415,222 * 5/1995 Colvin et al. ..... 165/46
5,456,701 * 10/1995 Stout ..... 165/46
5,722,482 * 3/1998 Buckley ..... 165/46
5,755,110 * 5/1998 Silvas ..... 165/46
6,004,662 * 12/1999 Buckley ..... 165/46
6,109,338 * 8/2000 Butze ..... 165/46
B1 4,856,294 * 5/1997 Scaringe et al. ..... 62/259

* cited by examiner

*Primary Examiner*—Ira S. Lazarus
*Assistant Examiner*—Terrell McKinnon
(74) *Attorney, Agent, or Firm*—Robert G. Rosenthal

(57) ABSTRACT

A support means or pad which is adapted to overlie an area to be thermally regulated. A plurality of microcapsules are dispersed within the support pad. The support means may be a porous pad or overlying layers of a mesh-type fabric. The fabric sheets include a series of channels which may be zig-zag in shape and are filled with a temperature stabilizing means, for example, a macroencapsulated phase change material. Suitable phase change materials are paraffinic hydrocarbons and water. In another aspect of the invention, the temperature stabilizing means is distributed within the support means in proportion to the underlying thermal load.

17 Claims, 3 Drawing Sheets

MICROCLIMATE TEMPERATURE REGULATING PAD AND PRODUCTS MADE THEREFROM

GOVERNMENT RIGHTS

This invention was supported by USMC SBIR Contract No. N00140-98-C-1461. The Government has certain rights in this invention.

FIELD OF THE INVENTION

This invention relates generally to the field of thermal control by means of a pad containing a temperature control means such as a phase change material and more specifically products such as wraps and vests made therefrom.

BACKGROUND OF THE INVENTION

It is known to employ microencapsulated phase change materials for the purpose of temperature regulation. For example, microencapsulated phase change materials have been incorporated into fibers and fabrics, foams and coated surfaces to achieve temperature regulation. However, as microcapsules are small (generally less than 1.0 mm), their thermal capacitance (and therefore the ability to cool) is limited. Also, when incorporated into foams and fabrics, they tend not to breath very well and as a result, moisture can be trapped which reduces temperature regulation, comfort and thermal efficiency.

In addition, blocks of phase change material have been incorporated into a vest as disclosed in U.S. Pat. No. 5,415,222. The blocks are adapted to fit within pockets and provide a cooling effect to the wearer. However, due to the size of the blocks, the moisture tends to become trapped between the skin of the wearer and the inside of the phase change material block which becomes uncomfortable for the wearer and which reduces the thermal efficiency of the garment. Another drawback to the use of large blocks of phase change material is the lack of flexibility which limits applications. Paraffinic wax phase change material is also a good insulator and prevents heat from being conducted away from the inside surface next to the body to the rest of the block.

It is accordingly an object of the present invention to provide a micro-climate temperature regulating pad that overcomes the above noted problems associated with the prior art devices.

More particularly, it is an object of the present invention is to provide a micro-climate temperature regulating pad that has increased thermal regulation capacity.

Another object of the present invention is to provide a micro-climate temperature regulating pad that is flexible.

Still another object of the present invention is to provide a micro-climate temperature regulating pad that permits air circulation therethrough.

Yet another object of the present invention is to provide a micro-climate temperature regulating pad that is comfortable.

A further object of the present invention is to provide a micro-climate temperature regulating pad that is inexpensive and which is easy to form into useful articles of commerce.

A further object of the present invention is to provide a micro-climate temperature regulating pad that can compensate for uneven rates of thermal radiation across a surface.

SUMMARY OF THE INVENTION

In accordance with the present invention, there is provided a support means or pad which is adapted to overlie an area to be thermally regulated. A plurality of macrocapsules containing a phase change material (or PCM) are dispersed within the support means. The support means may be a porous pad or overlying layers of a mesh-type fabric. The fabric sheets include a series of channels which may be zig-zag in shape and are filled with a temperature stabilizing means, for example, a macroencapsulated phase change material. Suitable phase change materials are paraffinic hydrocarbons and water.

In another aspect of the invention, the temperature stabilizing means is distributed within the support means in proportion to the underlying thermal load.

BRIEF DESCRIPTION OF THE DRAWINGS

Some of the features and advantages of the invention having been briefly stated, others will appear from the detailed description which follows, when taken in connection with the accompanying drawings, in which.

DETAILED DESCRIPTION OF THE PREFERRED EMBODIMENTS

While the present invention will be described more fully hereinafter, it is to be understood at the outset that persons of skill in the art may modify the invention herein described while still achieving the favorable results of this invention. Accordingly, the description which follows is to be understood as a broad teaching disclosure directed to persons of skill in the appropriate arts, and not as limiting upon the present invention.

The reader will note that the present invention is described herein with respect to a vest type garment, however, it will be understood that most articles of clothing could be constructed, as well as protective wraps for humans, animals or commercial goods. In addition, the micro-climate temperature regulating pad according to the present invention will also be incorporated in many as yet to be determined applications. For the sake of simplicity of discussion only, the present invention will be described in the context of a wearable vest as shown in the accompanying drawings.

Referring more particularly to the drawings, the vest according to the present invention is there illustrated. It will be noted that in the embodiment that was constructed (and as referred to herein) the vest is adapted to cool the wearer. However, with the proper selection of phase change material, the vest could also be employed as a warming vest.

The garment 10 is adapted to cover the upper portion of the wearer's body, and it is effective to cool the wearer as will be more fully explained hereinbelow.

Figure 6:
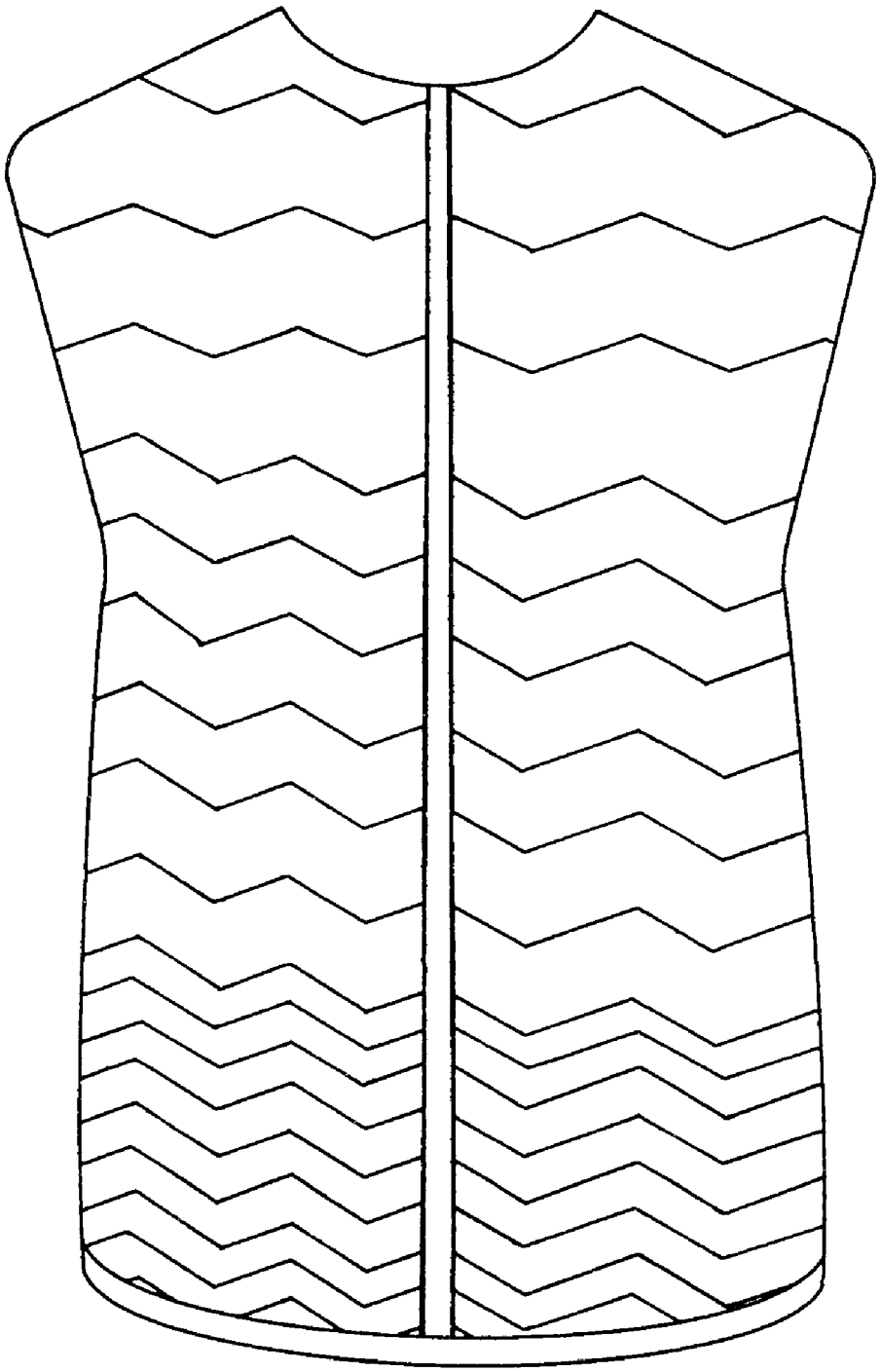
FIG. 6 is a schematic view of an alternate embodiment of the vest according to the present invention showing a zipper or hook and loop fastener system for entering and exiting the vest.

The vest comprises a generally rectangular sheet of flexible breathable material. The generally rectangular sheet has opposite end edges 11, 12 and opposite side edges 13, 14 and end edges 20, 21. The sheet further includes an opening 15 in a medial location to define front and rear panels 16, 17 respectively on opposite sides of the opening 15 so that the sheet is adapted to be positioned on a wearer with the wearer's head extending through the opening and with the front and rear panels respectively overlying the chest and back of the wearer. The vest according to the present invention can also be constructed as a front opening garment, similar to the standard military flak jacket. In the aforementioned flak jacket, the two front sides are held together via a hook and loop fastener system (schematically shown) as shown in FIG. 6. A conventional zipper may also be employed.

As illustrated in the figure, the front and rear panels are formed from separate pieces of a fine mesh material such as NYLON® or polypropelene. For ease of entry, the panels are sewn together along one pair of contiguous edges that overlie one of the shoulders. The other pair of contiguous edges are adapted to be held together by means of hook and loop fasteners 18 positioned on the underside of the strap members 19 and 20 on the panels. The front and rear panels 16, 17 are adapted to closely conform to the shape of the wearer. Strap means or side straps 19 extend from the side edge 13 and are adapted to be connected to the side edge of the opposite panel, again by hook and loop fasteners (not shown). In this manner, the vest is provided with additional flexibility as depending on the waistline of the wearer, close conformity with the body of the wearer can be assured to maximize thermal transfer.

In the illustrated embodiment of the invention, the panels 16, 17 are formed from overlying sheets of fabric. A series of zig-zag or herring bone shaped channels are formed the panels. The channels may be formed by any of the conventional means compatible with the material used (i.e., stitching, fusion, etc.). The material is a relatively fine mesh type material wherein the mesh openings are small enough to contain the macrocapsules. The channels may be of varying width to accommodate differing quantities of macrocapsules. In addition, fabrics or pads have been developed wherein the bulk is obtained by an irregular or random distribution of fibers. Marcocapsules can be distributed within the interstitial spaces between the fibers such that they remain trapped therein.

It has been recently learned that different areas of the body radiate or transport heat at rates higher than others. More specifically, in areas where large blood vessels are closer to the surface (such as the head, chest and neck), more heat emanates from the body. In addition, it has also been discovered that heat radiates differently between men and women. The benefits and advantages of variable macrocapsule loading will be described in greater detail hereinbelow.

Figure 4:
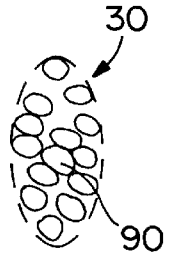
FIG. 4 is a side view of one of the channels taken along line 3—3 of FIG. 1.
Figure 3:
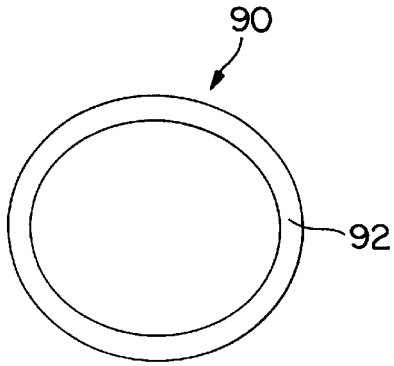
FIG. 3 is a cross section of a macrocapsule as employed in the present invention.

The macrocapsules comprise a glass or polymer shell that contains a temperature stabilizing means such as a phase change material. A macrocapsule 90 (generally greater than 1.00 mm in diameter) is illustrated in FIG. 4 and comprises an outer wall 92 and a phase change material filling. A number of phase change materials which have a cooling effect are available, but the paraffinic hydrocarbons are preferred since they are non-toxic, relatively inexpensive and can be contained within plastic films. The table below lists a number of bulk paraffinic compounds whose number of carbon atoms dictate where the material will change phase.

| COMPOUND NAME | NUMBER OF CARBON ATOMS | MELTING POINT DEGREES CENTIGRADE |
|---|---|---|
| n-Octacosane | 28 | 64.1 |
| n-Heptacosane | 27 | 59.0 |
| n-Hexacosane | 26 | 56.4 |
| n-Pentacosane | 25 | 53.7 |
| n-Tetracosane | 24 | 50.9 |
| n-Tricosane | 23 | 47.6 |
| n-Docosane | 22 | 44.4 |
| n-Heneicosane | 21 | 40.5 |
| n-Eicosane | 20 | 36.8 |
| n-Nonadecane | 19 | 32.1 |
| n-Octadecane | 18 | 28.2 |
| n-Heptadecane | 17 | 22.0 |
| n-Hexadecane | 16 | 18.2 |
| n-Pentadecane | 15 | 10.0 |
| n-Tetradecane | 14 | 5.9 |

Each of the materials above is most effective near the melting point indicated above. It will be seen from the foregoing, that the effective temperature range of the vest can be tailored to a specific environment by selecting the phase change material(s) required for the corresponding temperatures and placing the phase change material therein. In addition, silica or other gels may also be employed.

As mentioned hereinabove, the macrocapsules are dispersed within a series of channel means or channels 30 formed in the vest panels. The channels 30 may be of any shape to accomplish the desired result (i.e., straight, circular, zig-zag, spiral, etc.) and still be within the scope of the invention. Notwithstanding the foregoing, when taken with respect to the illustrated embodiment, a zig-zag or herring-bone pattern is preferred. This pattern permits the vest to flex sufficiently to conform to the shape of the person wearing it. In addition, such a shape minimizes packing or shifting of the particles which can cause "hot spots" (uneven heat absorption).

Figure 1:
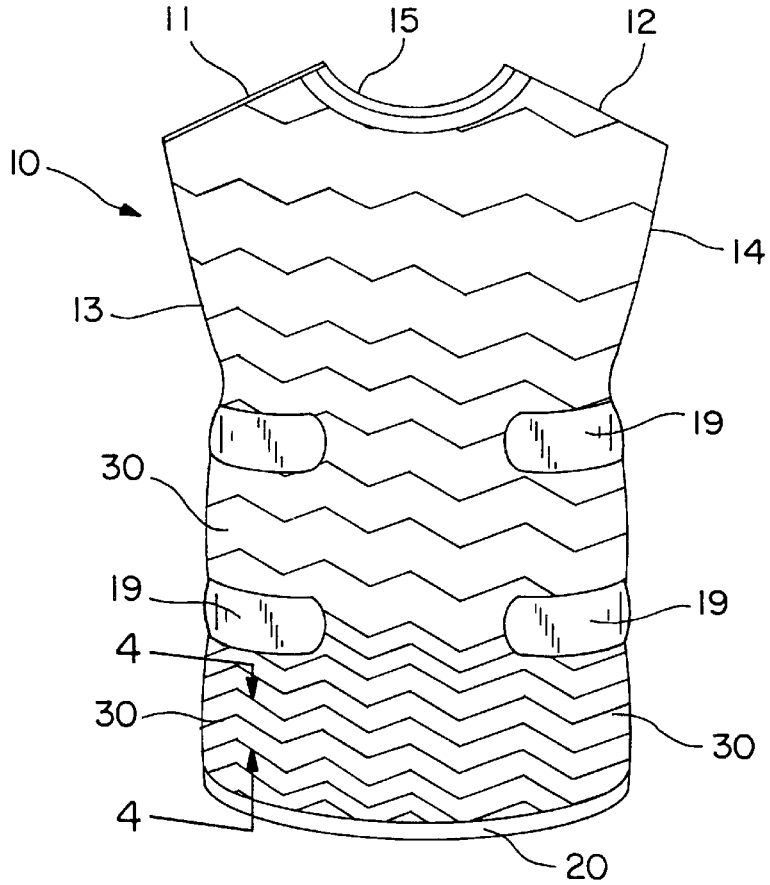
FIG. 1 is a front view of the cooling garment according to the present invention.
Figure 5:
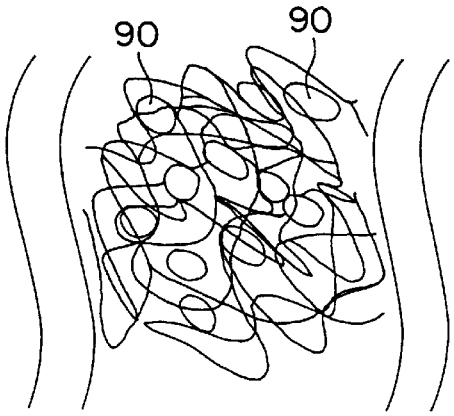
FIG. 5 is a schematic view of an alternate embodiment of the support means of the present invention.
Figure 2:
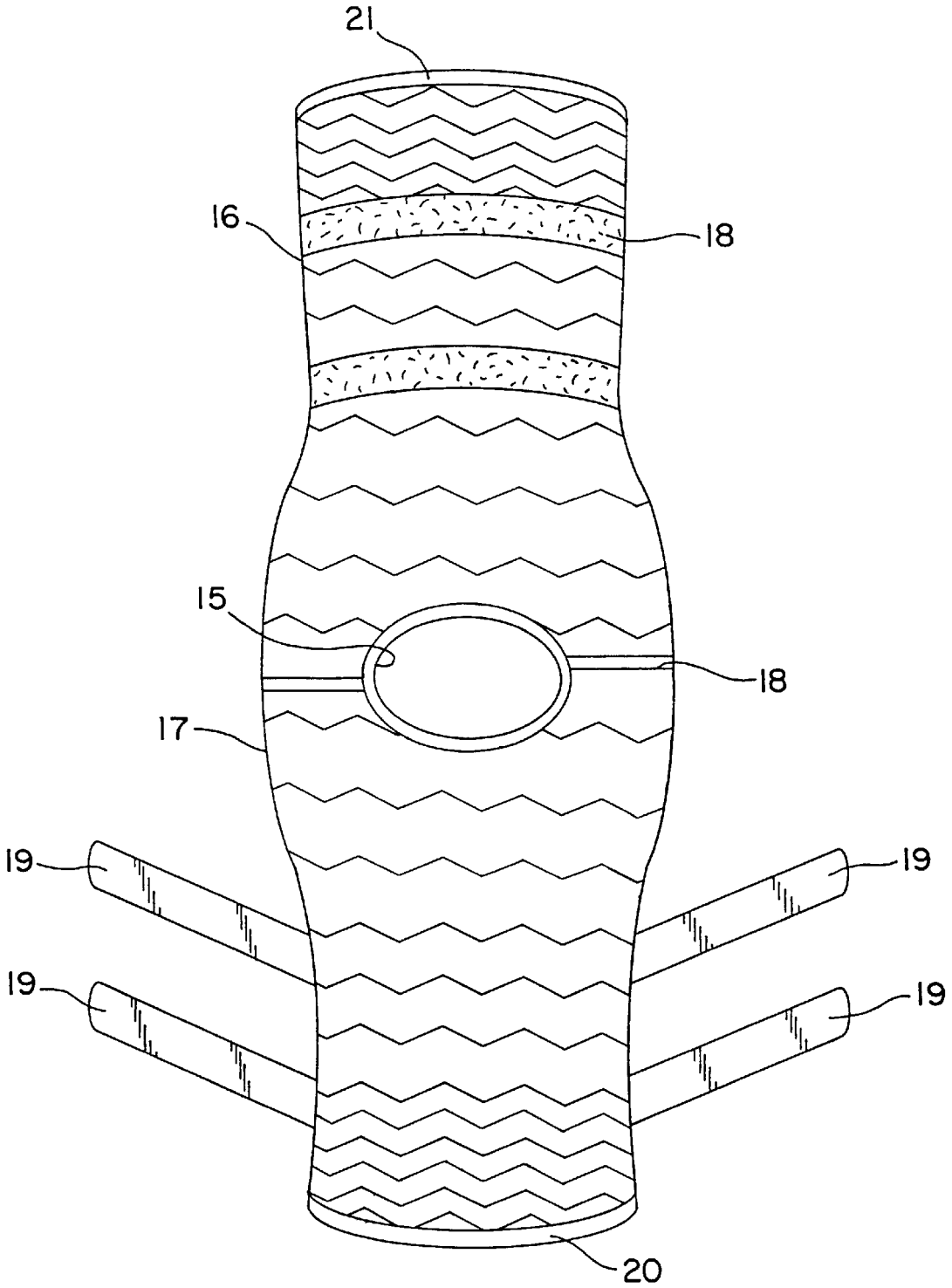
FIG. 2 is a top view of vest cooling garment according to the present invention.

As briefly mentioned, thermal radiation or heat transport occurs from different parts of the body at different rates. Therefore, in order to cool those areas generating higher amounts of heat, the section of vest that overlies these areas can be loaded to contain more macrocapsules. With respect to the embodiment illustrated in FIGS. 1, 2, and 4, the channel width (i.e., the distance between parallel rows of stitching) is increased which permits increased macrocapsule loading.

In another aspect of the invention, it has been learned that air flow between the heat source and the environment extends the cooling effects of the vest. In addition, air flow around the macrocapsules aids in conduction of the heat out of and away from the heat source. The porous nature of the support means and the use of macrocapsules facilitate enhanced cooling.

In operation, the wearer places his head through the large medial opening in the vest overlying his shoulders. The side straps 19 are then tightened to provide a snug fit against the torso. Upon exertion by the wearer, perspiration is allowed to exit via the openings in the support means and through the interstitial spaces between the macrocapsules.

The foregoing embodiments and examples are to be considered illustrative, rather than restrictive of the invention, and those modifications which come within the meaning and range of equivalence of the claims are to be included therein.

That which is claimed is:

1. A micro-climate regulating pad adapted to overlie an area to be thermally regulated characterized by its ability to absorb unevenly distributed thermal loads and comprising:

a support means being constructed and arranged to permit air flow therethrough; and a plurality of macroencapsulated temperature stabilizing means dispersed within said support means such that air may pass from the thermal load through the support means and between said macroencapsulated temperature stabilizing means and further wherein the quantity of macroencapsulated temperature stabilizing means is proportional to the underlying thermal load, whereby the temperature across an unevenly distributed thermal load is maintained at a substantially uniform temperature.

2. A micro-climate regulating pad according to claim 1 wherein said temperature stabilizing means comprises a phase change material.

3. A micro-climate regulating pad according to claim 2 wherein said phase change material is selected from the group comprising paraffinic hydrocarbons, gels and water.

4. The microclimate regulating pad according to claim 1 wherein said support means comprises a porous pad having interstitial spaces adapted to hold said macrocapsules and to permit airflow therethrough.

5. The microclimate regulating pad according to claim 1 wherein said support means includes a channel means adapted to hold said plurality of macroencapsulated temperature stabilizing means.

6. The microclimate regulating pad according to claim 1 wherein said support means comprises a pair of overlying sheets constructed and arranged to define a plurality of channels therebetween and wherein said plurality of macroencapsulated temperature stabilizing means are positioned within said channels.

7. The microclimate regulating pad according to claim 6 wherein said channels are non-linear whereby packing is minimized.

8. A vest characterized by its ability to cool the wearer for an extended period of time and to absorb an unevenly distributed thermal load generated by the wearer and comprising:

a generally rectangular sheet of flexible material constructed and arranged to permit air flow therethrough having opposite end edges and opposite side edges, said sheet including an opening in a medial location to define front and rear panels on opposite sides of the opening so that said sheet is adapted to be positioned on a wearer with the wearer's head extending through said opening with the front and rear panels respectively overlying the chest and back of the wearer, said sheet including an internal cavity; and a plurality of macroencapsulated temperature stabilizing means positioned within said cavity such that air may pass from the thermal load through the support means and between said macroencapsulated temperature stabilizing means and further wherein the quantity of macroencapsulated temperature stabilizing means is proportional to the underlying thermal load, whereby the temperature across an unevenly distributed thermal load is maintained at a substantially uniform temperature.

9. A vest according to claim 8 wherein said cavity is further subdivided into a plurality of channel means formed between said overlying sheets of material.

10. The vest according to claim 9 wherein said channel means are non-linear.

11. The vest according to claim 8 wherein said channel means are adapted to hold preselected varying quantities of macroencapsulated temperature stabilizing means.

12. The vest according to claim 11 wherein the quantity of macroencapsulated temperature stabilizing means within each of said channel means is proportional to the respective width of said channel means, and loop fastener system to connect the opposing sides of said front panel.

13. The vest according to claim 8 wherein said front sheet includes closure means for facilitating entry and exit of the wearer.

14. The vest according to claim 13 wherein said front panel is divided from said head opening to said end edge and wherein said closure means comprises a hook and loop fastener system to connect the opposing sides of said front panel.

15. A micro-climate regulating pad according to claim 8 wherein said temperature stabilizing means comprises a phase change material.

16. The microclimate regulating pad according to claim 8 wherein said support means comprises a porous pad having interstitial spaces adapted to hold said macrocapsules and to permit airflow therethrough.

17. A micro-climate regulating pad according to claim 15 wherein said phase change material is selected from the group comprising paraffinic hydrocarbons, gels and water.

* * * * *